US007347004B1

(12) United States Patent
Halvorsen

(10) Patent No.: US 7,347,004 B1
(45) Date of Patent: Mar. 25, 2008

(54) FREEZE DRYING APPARATUS AND METHOD

(75) Inventor: Matthew J. Halvorsen, Hopkinton, NH (US)

(73) Assignee: Lyophilization Services of New England, Inc., Manchester, NH (US)

( * ) Notice: Subject to any disclaimer, the term of this patent is extended or adjusted under 35 U.S.C. 154(b) by 293 days.

(21) Appl. No.: 11/035,376

(22) Filed: Jan. 13, 2005

(51) Int. Cl.
*F26B 13/30* (2006.01)

(52) U.S. Cl. ..... 34/92; 34/73; 34/76

(58) Field of Classification Search ..... 34/92, 34/72, 73, 74, 76, 84
See application file for complete search history.

(56) References Cited

U.S. PATENT DOCUMENTS 3,199,217 A * 8/1965 Oldenkamp et al. ..... 34/92
3,245,152 A 4/1966 Natelson et al.
3,354,609 A 11/1967 Nerge et al.
3,460,269 A * 8/1969 Kessler ..... 34/92
3,461,953 A 8/1969 Costello et al.
3,728,798 A 4/1973 Wehrmann
3,795,986 A 3/1974 Sutherland et al.
4,081,914 A 4/1978 Rautenbach et al.
4,407,140 A 10/1983 Kobayashi
4,449,305 A 5/1984 Baron et al.
4,547,977 A 10/1985 Tenedini et al.
4,640,020 A 2/1987 Wear et al.
4,802,286 A 2/1989 Kobayashi et al.
4,953,299 A 9/1990 Gimeno et al.
5,398,426 A 3/1995 Connor
5,428,905 A 7/1995 Beurel et al.
5,519,946 A 5/1996 Renzi
5,689,898 A 11/1997 Renzi
5,743,023 A 4/1998 Fay et al.
5,937,536 A 8/1999 Kieselbach et al.
6,122,836 A 9/2000 Tenedini et al.
6,226,887 B1 5/2001 Tenedini et al.
6,543,155 B2 4/2003 Horigane
6,935,049 B2 * 8/2005 Alstat ..... 34/92
2002/0174562 A1 11/2002 Pearcy et al.

FOREIGN PATENT DOCUMENTS

JP 58074103 A * 5/1983

* cited by examiner

*Primary Examiner*—Jiping Lu
(74) *Attorney, Agent, or Firm*—McLane, Graf, Raulerson & Middleton, P.A.; Scott C. Rand

(57) ABSTRACT

A lyophilization apparatus includes a chamber and plural drying shelves arranged in vertically spaced apart relation. Each shelf has an inlet, outlet, and flow passageway therebetween. Plural sets of shelves are independently coupled to separate sources of circulating heat exchange fluid. In a preferred embodiment, every second shelf is fluidically coupled to a first inlet manifold and a first outlet manifold, and every other shelf is fluidically coupled to a second inlet manifold a second outlet manifold. The first inlet and outlet manifolds are fluidically coupled to a first circulating source of heat exchange fluid and the second inlet and outlet manifolds are fluidically coupled to a second circulating source of heat exchange fluid, whereby the temperature of each drying shelf can be controlled independently of a vertically adjacent one of the drying shelves. In a further aspect, a lyophilization process is also provided.

6 Claims, 2 Drawing Sheets

FREEZE DRYING APPARATUS AND METHOD

BACKGROUND OF THE INVENTION

The present invention relates to lyophilization or freeze drying and, in particular, to an improved freeze drying apparatus and method which permits the temperature of adjacent shelves to be independently controlled.

Lyophilization is a widely used method for drying a variety of materials, including biological materials, pharmaceutical materials and medical devices, comestibles, and others. Freeze dryers commonly include a freeze drying chamber, shelves in the chamber for holding the product or products to be freeze dried, a condenser, e.g., with refrigeration coils, a vacuum system, and fluid conduits for connecting the various freeze dryer components. Generally, the freeze dryer shelves are cooled and heated during the freeze drying cycle with cooling and heating means, such as a heat exchanger and a heat transfer fluid circulating through the shelves or through tubes lining the shelves.

Typically, the products or materials to be freeze dried are placed in containers (e.g., open or partially opened containers, molds, trays, bags, vials, and so forth), which are then placed on the freeze dryer shelves within the chamber. After the chamber door is closed, the shelves are cooled to freeze the product, typically to about negative 40 degrees Celsius or lower, although higher temperatures may be used (e.g., up to about negative 10 degrees Celsius). Alternatively, one may load onto a pre-frozen shelf. Thermocouples or other temperature probes may be provided to indicate when the product is frozen and at the correct temperature. The freeze dryer chamber and condenser are then evacuated to a deep vacuum using a vacuum pump system, e.g., to a vacuum of about 1 Torr or lower, while vapor condenser coils or plates are cooled, e.g., to around negative 50 degrees Celsius or lower. The shelves are warmed through the controlled addition of heat by circulating a thermal exchange medium through the shelves to provide energy to sublimate the solvent.

The moisture (or other volatile constituents) driven from the product is drawn in vapor form out of the chamber to the condenser, where it condenses and freezes on the condenser coils. Alternatively, the unit may have an internal condenser. This process continues until the product is sufficiently freeze dried as may be determined by known means, after which the chamber is vented to atmospheric pressure, the chamber door is opened, and the freeze-dried product removed.

Commonly, the shelves are arranged in a vertical stack, with a vertical inlet manifold for delivering the thermal fluid to each of the shelf inlets and a vertical outlet manifold arranged on the opposite side of the shelves. The heating and cooling of the product to be freeze dried occurs primarily through conductive heat transfer between the product and the shelf holding the product (and secondarily by convective and radiant heat transfer) and a number of methods have been proposed for minimizing the effect of an adjacent shelf on the product sitting on the shelf below. For example, modular systems have been proposed wherein each shelf or, in some cases each specimen to be lyophilized, is provided with a separate evacuation chamber. Also, it has been proposed to interpose an active or passive heat shield between vertically adjacent lyophilization shelves. The present invention contemplates a new and improved lyophilization apparatus and method which is of simple construction and inexpensive to manufacture, and can be validated for use in regulated production of medical devices and drugs.

SUMMARY OF THE INVENTION

In one aspect, a lyophilization apparatus includes a housing defining an evacuation chamber and a plurality of horizontal drying shelves arranged in vertically spaced apart relation. Each drying shelf has at least one inlet and outlet, and a flow passageway defined therebetween. A first source of heat exchange fluid fluidically coupled to a first set of said drying shelves and a second source of heat exchange fluid fluidically coupled to a second set of said drying shelves.

In a preferred embodiment, the inlet of every second drying shelf is fluidically coupled to a first inlet manifold and the inlet of every other drying shelf is fluidically coupled to a second inlet manifold. The outlet of every second drying shelf is fluidically coupled to a first outlet manifold and the outlet of every other drying shelf is fluidically coupled to a second outlet manifold. The first inlet manifold and the first outlet manifold are fluidically coupled to a first circulating source of heat exchange fluid and the second inlet manifold and the second outlet manifold are fluidically coupled to a second circulating source of heat exchange fluid, whereby the temperature of each drying shelf can be controlled independently of a vertically adjacent one of the drying shelves.

In another aspect, a method for lyophilizing a product in a chamber having a plurality of horizontal drying shelves for supporting the product to be lyophilized is provided. The drying shelves are arranged in vertically spaced apart relation and each drying shelf has an inlet, an outlet, and flow passageway therebetween. The product to be lyophilized is positioned within the chamber and is cooled to freeze the product. The chamber is evacuated to a pressure lower than atmospheric pressure and heat is supplied to the product to cause sublimation of moisture contained within the product. A heat exchange fluid is circulated through a first set of the plurality of drying shelves and a heat exchange fluid is circulated through a second set of the plurality of drying shelves independently of the heat exchange fluid circulating in the first set of drying shelves.

One advantage of the present invention resides in its ability to independently control alternating sets of shelves to provide an advantageous temperature configuration during the entire lyophilization process, including the freeze down. Thus, independent control of adjacent shelves allows control of temperature gradients both in magnitude and direction to be established. This ability can also, if so desired, minimize heat transfer between the product being processed on one shelf and the adjacent shelf. Additionally, independent control of adjacent shelves allows, if so desired, establishing a desired temperature differential between the shelf on which a product is resting and an adjacent shelf (which may be lowered onto a mold to aid heat and transfer) which may result in benefits such as higher quality product, structures not obtainable with conventional equipment, or improved freeze drying efficiency.

Another advantage of the present invention is that the apparatus can be run at one-half capacity, i.e., utilizing heating/cooling circulation loops and only one set of shelves, thereby reducing energy usage by approximately one-half. Of course, the unit may also be operated in standard fashion, e.g., wherein adjacent shelves are the same temperature.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawing is only for purposes of illustrating the preferred embodiment and is not to be construed as limiting the invention.

DETAILED DESCRIPTION OF THE PREFERRED EMBODIMENT

Figure 1:
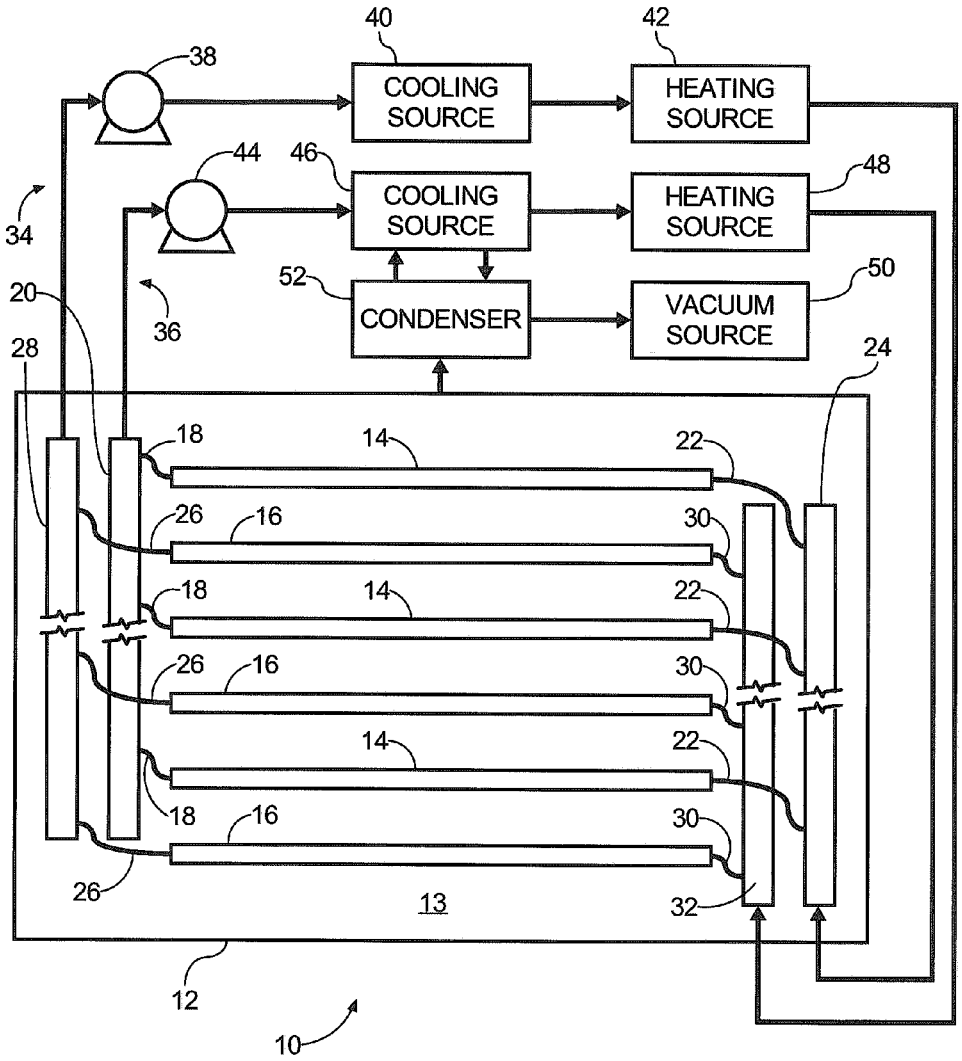
FIG. 1 schematically illustrates a freeze drying apparatus according to a first exemplary embodiment of the invention.

Referring now to the drawing Figure, a lyophilization apparatus 10 according to a preferred embodiment includes a housing 12 defining an evacuation chamber 13. A first set of shelves 14 and a second set of shelves 16 are vertically arranged in alternating fashion within the housing 12. That is, every second shelf is a shelf 14 of the first set and every other shelf is a shelf 16 of the second set. The shelves 14 and 16 are supported in vertical, spaced-apart relation via brackets or other supports within the housing 12, e.g., via supports (e.g., hanging rods) secured to an interior wall of the housing 12. The number of shelves depicted is exemplary only, and any desired number of shelves may be employed. Also, more than two sets of alternating sets of shelves may be provided, e.g., with each additional set having an inlet and outlet manifold and a separate heating and cooling circuit, and arranged in the vertical stack of shelves in repeating fashion. The shelves 14 and 16 are preferably of a hollow, thermally conductive type having internal baffles or ribs arranged to define a circuitous or tortuous flow passageway therethrough. Other known lyophilization shelf types, such as tube-lined shelves, are also contemplated.

Each shelf 14 in the first set of shelves is fluidically coupled to a first common inlet manifold 24 via an inlet hose 22 and each shelf 16 in the second set is fluidically coupled to a second common inlet manifold 32 via an inlet hose 30. Likewise, each shelf 14 in the first set is fluidically coupled to a first common outlet manifold 20 via an inlet hose 18 and each shelf 16 in the second set is fluidically coupled to a second common outlet manifold 28 via an inlet hose 26. In alternative embodiments, each shelf may have more than one inlet and inlet hose and/or outlet and outlet hose coupling the shelf to the respective inlet and/or outlet manifold.

The first inlet manifold 24 and the first outlet manifold 20 are fluidically coupled to a first heating and cooling circuit 36 and the second inlet manifold 32 and the second outlet manifold 28 are fluidically coupled to a second heating and cooling circuit 34. The first heating and cooling circuit 36 includes a circulation pump 44 for circulating a heat transfer fluid through the shelves 14 for effecting heat transfer with a product or specimen (not shown) thereon to be freeze dried and/or to otherwise heat or cool the shelves 14 to a desired temperature. A cooling source 46, such as a refrigeration unit or the like, and a heating source 48 are provided for selectively heating and cooling the heat transfer fluid delivered to the shelves 14.

The second heating and cooling circuit 34 includes a circulation pump 38 for circulating a heat transfer fluid through the shelves 16 for effecting heat transfer with a product or specimen (not shown) thereon to be freeze dried and/or to otherwise heat or cool the shelves 16 to a desired temperature. A cooling source 40 and a heating source 42 are provided for selectively heating and cooling the heat transfer fluid delivered to the shelves 16.

A vacuum source 50, such as a vacuum pump, is provided to evacuate the chamber 13 during the drying phase of the freeze drying process. In the depicted embodiment, a condenser 52 is in heat exchange relation with a cooling source. The condenser 52 is depicted as being in heat exchange relation the cooling source 46, although it will be recognized that either or both of the cooling sources 40 and 46 may be used to provide cooling to the condenser 52. Alternatively, a dedicated cooling source may be provided to cool the condenser 52. The condenser 52 condenses the water vapor which sublimates from the product being dried. In an alternative embodiment, an internal condenser may be employed. The shelf temperature and/or circulation of the heat transfer fluid may be controlled manually or under automated or preprogrammed control.

Figure 2:
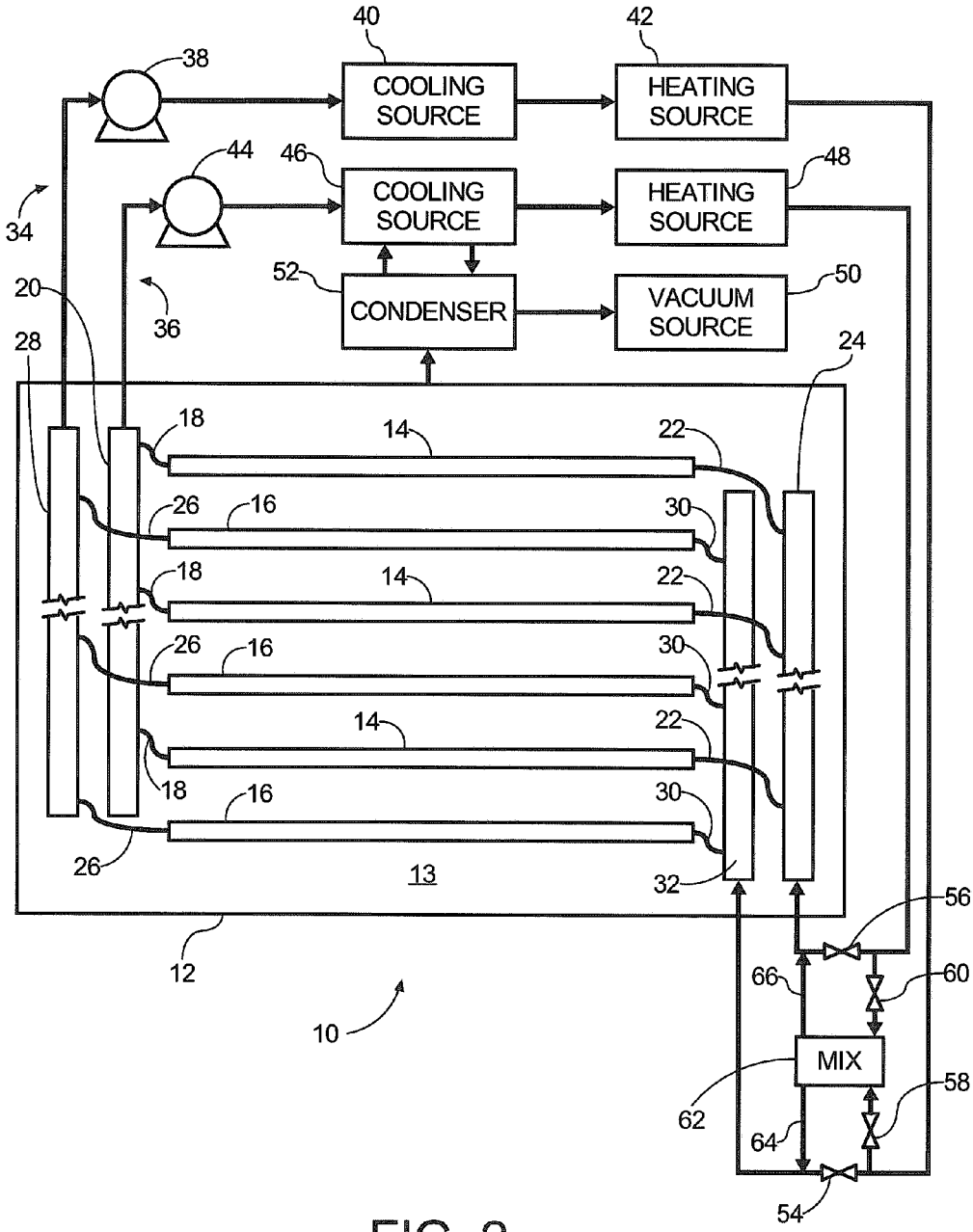
FIG. 2 schematically illustrates a freeze drying apparatus according to a second exemplary embodiment of the invention.

Referring now to FIG. 2, there is shown a second embodiment lyophilizer 10'. Like reference numerals appearing in FIG. 2 are as described above by way of reference to FIG. 1. FIG. 2 further includes a mixing function which ensures that all shelves are the same temperature if so desired, for example, if it desired to operate the unit so that it functions in same fashion as a conventional unit of a type wherein all of the shelves share a common inlet manifold and a common outlet manifold.

Valves 54 and 56 are provided in circulation loops 34 and 36, respectively. By closing the valves 54 and 56, the fluid in the circuits 34 and 36 may be directed to a mixer 62, which may be a container or conduit which allows the fluids in the circuits 34 and 36 to commix. Valves 58 and 60 may be provided which are closed when the valves 54 and 56 are open and the shelves 14 are to be controlled independently of the shelves 16. Likewise, the valves 58 and 60 are open when the valves 54 and 56 are closed to allow intermixing of the fluid in the circuits 34 and 36 when the shelves 14 and 16 are intended to have a uniform temperature. The mixed fluid exiting the mixer 62 is then delivered back to the circuit 34 via a conduit 64 and to the circuit 36 via a conduit 66. The fluid entering the inlet manifold 32 has the same temperature as the fluid entering the inlet manifold 24, thereby allowing the shelves 14 and 16 to be cooled and/or heated uniformly. It will be recognized that the shelf temperature, circulation of the heat transfer fluid, and/or valves 54-60 may be controlled manually or under automated or preprogrammed control.

The invention has been described with reference to the preferred embodiment. Modifications and alterations will occur to others upon a reading and understanding of the preceding detailed description. For example, the apparatus as described herein could be adapted for use as a freezing chamber wherein the product, once frozen, is subsequently transferred to a conventional side dryer for drying. It is intended that the invention be construed as including all such modifications and alterations insofar as they come within the scope of the appended claims or the equivalents thereof.

Having thus described the preferred embodiments, the invention is now claimed to be:

1. A lyophilization apparatus, comprising:

a housing defining an evacuation chamber;

a plurality of horizontal drying shelves, each of said drying shelves being arranged in vertically spaced apart relation, each drying shelf having an inlet, an outlet, and flow passageway between the inlet and the outlet;

a first source of heat exchange fluid fluidically coupled to a first set of said drying shelves;

a second source of heat exchange fluid fluidically coupled to a second set of said drying shelves;

a mixer which is selectively fluidically coupled to the first and second sets of drying shelves for receiving heat exchange fluid from said first and second sources of heat exchange fluid; and when the mixer is fluidically coupled to the first and second sets of drying shelves, said mixer delivering the heat exchange fluid to the first and second sets of drying shelves at substantially the same temperature.

2. The lyophilization apparatus of claim 1, further comprising:

first and second inlet manifolds;

first and second outlet manifolds;

the inlet of every second drying shelf is fluidically coupled to the first inlet manifold and the inlet of every other drying shelf is fluidically coupled to the second inlet manifold;

the outlet of every second drying shelf is fluidically coupled to the first outlet manifold and the outlet of every other drying shelf is fluidically coupled to the second outlet manifold; and the first inlet manifold and the first outlet manifold are fluidically coupled to a first circulating source of heat exchange fluid and the second inlet manifold and the second outlet manifold are fluidically coupled to a second circulating source of heat exchange fluid, whereby the temperature of each drying shelf can be controlled independently of a vertically adjacent one of the drying shelves.

3. The apparatus of claim 1, wherein the first inlet manifold and the first outlet manifold are selectively fluidically coupled to a first circulating source of heating fluid and a first circulating source of cooling fluid and the second inlet manifold and the second outlet manifold are selectively fluidically coupled to a second circulating source of heating fluid and a second circulating source of cooling fluid.

4. The apparatus of claim 3, further comprising a vacuum source and a condenser, wherein said condenser is cooled by at least one of the first and second sources of cooling fluid.

5. The apparatus of claim 1, further comprising a vacuum source and a condenser.

6. The apparatus of claim 1, wherein each of the drying shelves is hollow.

* * * * *